US005477785A

United States Patent [19]

Dieman, Jr. et al.

[11] Patent Number: 5,477,785

[45] Date of Patent: Dec. 26, 1995

[54] WELL PIPE PERFORATING GUN

[75] Inventors: Charles A. Dieman, Jr., Suffield; Daniel A. Toro, Waterbury; Thomas C. Tseka, West Suffield; James E. Fritz, Ellington; Scot P. Riley, Granby; Craig J. Boucher, Simsbury; Steven L. Renfro, Granby, all of Conn.

[73] Assignee: The Ensign-Bickford Company

[21] Appl. No.: 379,303

[22] Filed: Jan. 27, 1995

[51] Int. Cl.[6] ..... F42B 3/00; E21B 17/14

[52] U.S. Cl. ..... 102/313; 175/4.51; 175/433

[58] Field of Search ..... 102/312, 313; 175/4.51, 432, 433; 166/242

[56] References Cited

U.S. PATENT DOCUMENTS 2,761,384 9/1956 Sweetman ..... 102/307 X 3,797,576 3/1974 Azalbert et al. ..... 175/4.51 X 5,031,540 7/1991 Kenny ..... 102/312 X 5,105,742 4/1992 Sumner ..... 102/312

*Primary Examiner*—Peter A. Nelson

*Attorney, Agent, or Firm*—Victor E. Libert; Frederick A. Spaeth

[57] ABSTRACT

A well pipe perforating gun (10) is improved by the utilization of a pulverable support structure (14) to hold the explosive shaped charges (18*a*, 18*b*, etc.) and the fireset (20). When the gun (10) is fired, the support structure (14) disintegrates substantially into fragments too small to obstruct the flow of oil or natural gas from a surrounding earth formation into or through the well pipe (12) within which the gun is disposed. Optionally, the support structure (14) is assembled from a number of segments (14*a*, 14*b*, etc.) linked together in sequential fashion.

7 Claims, 2 Drawing Sheets

WELL PIPE PERFORATING GUN

BACKGROUND OF THE INVENTION

1. Field of the Invention

The present invention relates to petroleum and gas recovery devices and in particular to perforating guns used to perforate well pipes in oil or natural gas wells.

2. Related Art

Generally speaking, oil or natural gas may be extracted from the earth by drilling a well into a suitable earth formation. A metal well pipe or casing is inserted vertically into the well to a depth corresponding to the location of the oil or gas, and concrete is inserted into the annular space between the exterior of the well pipe and the well. When it is desired to cause gas or oil to flow into the pipe for extraction, a perforating gun is inserted into the well pipe to the depth from which it is desired to recover oil or gas. The perforating gun conventionally comprises a closed metal cylinder containing a fireset (circuitry and controls to initiate the explosives contained in the perforating gun) and a plurality of penetrating shaped charges that are fired to horizontally perforate the well pipe, allowing oil or gas to flow into the pipe and to the surface for recovery. The closed metal cylinder of the perforating gun serves to protect the explosive shaped charges and the fireset from heat, pressure and damage from water or other contaminants in the well pipe, prior to firing.

In an alternative prior art configuration, a plurality of encased shaped charges are suspended by metal chains within the well pipe at various appropriate positions. Conventionally, the shaped charges are fired using a firing signal transmission line that extends to the surface of the well site. In either case, the explosive shaped charges horizontally penetrate the well pipe and the hardened concrete surrounding it, and form openings in the surrounding earth to enable the flow of natural gas or oil.

SUMMARY OF THE INVENTION

The present invention provides an improvement in a well pipe perforating gun comprising a support structure, at least one explosive penetrator and a fireset operatively connected to the at least one explosive penetrator. The support structure is dimensioned and configured to juxtapose the at least one explosive penetrator in perforating relation to the interior of the well pipe. The improvement comprises that the support structure comprises a pulverable material, whereby the support structure disintegrates into non-obstructive debris when the gun is fired.

According to one aspect of the invention, the pulverable material comprises a phenolic material.

According to another aspect of the invention, the support structure may comprise a sealing means dimensioned and configured to slideably engage the interior of the pipe.

According to still another aspect of the invention, the support structure may be perforated and the fireset and the explosive penetrator may comprise protective casings.

Optionally, the support structure may comprise a plurality of sequentially linked segments. Each segment may have a generally cylindrical configuration having two ends and at least one tenon at one end and a mortise aperture at the other end. The mortise aperture may be dimensioned and configured to receive a tenon dimensioned and configured like the at least one tenon.

Preferably the fireset comprises an autonomous fireset.

DETAILED DESCRIPTION OF THE INVENTION AND PREFERRED EMBODIMENTS THEREOF

One problem of conventional perforating guns is that when fired, the metal cylinder or suspending chain breaks into fragments that can clog the perforations created by the gun or the inside of the well pipe. The present invention provides a perforating gun that comprises, instead of a metal cylinder or suspending chains, a pulverable support structure for the shaped charges, which upon firing, is substantially pulverized or which otherwise substantially disintegrates into fragments too small to obstruct the flow of oil or gas into or through the well pipe.

In accordance with the present invention, a cylinder-type perforating gun comprises a pulverable cylinder which serves as a support structure within which explosive penetrators are positioned and onto which a fireset assembly is secured to control the firing of the explosive penetrators. In one embodiment, the cylindrical support structure is perforated, i.e., it is open to the introduction of ground water or other fluids in the well pipe, and so the explosive penetrators and fireset assembly comprise protective casings within which the shaped charges and fireset circuitry are sealed, respectively. Preferably, the casings for the explosive penetrators and for the fireset circuitry comprise pulverable materials.

Since the fireset and shaped charges must be protected from heat, pressure and damage from water or other contaminants in the well pipe prior to firing, the pulverable material for the casings for these components must provide a hydraulic seal about the component and must be able to withstand the pressures that may be encountered in the well pipe prior to firing, e.g., pressures up to about 22,000 psi. For this reason the pulverable material used for the casings is preferably a ceramic material, e.g., alumina.

Since the support structure is not enclosed, it need not have the structural strength of the casings for the explosive penetrators and the fireset assembly. Accordingly, there is somewhat more flexibility in the choice of materials used for the support structure. As an alternative to ceramics, one pulverable material that may be used to form the support structure is synthetic phenolic crosslinked material, which may be compression-molded into linkable segments as described below. One suitable phenolic material is commercially available under the trade designation DUREZ 13856 AF black phenolic, obtained from Occidental Chemical. Corporation.

Figure 1:
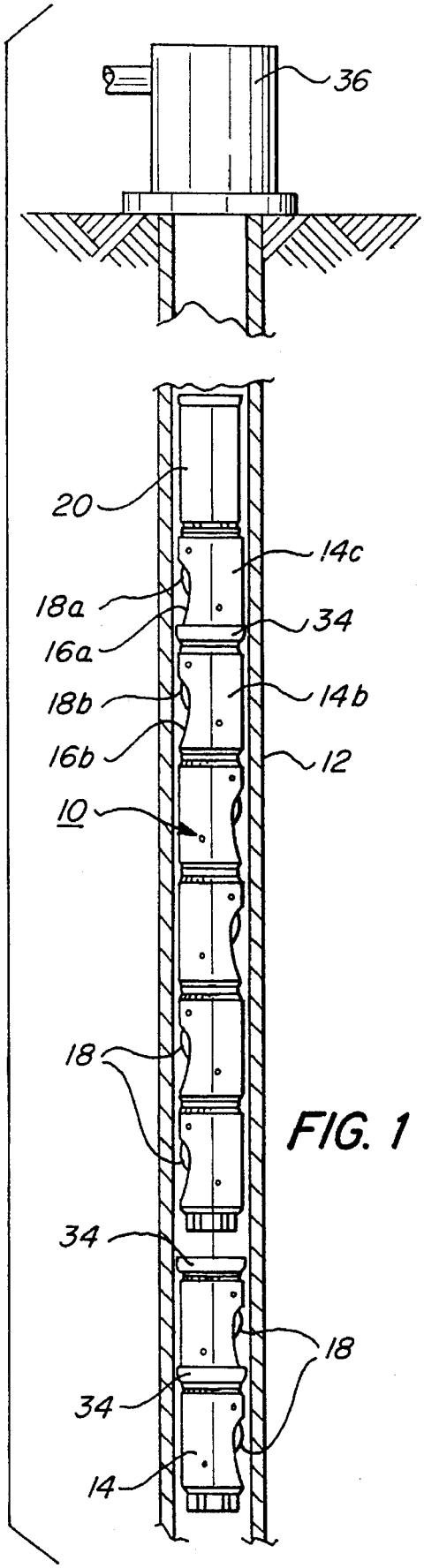
FIG. 1 is a schematic partly cross-sectional view of a perforating gun, in accordance with the present invention, disposed within a well pipe.

A perforating gun in accordance with one embodiment of the present invention is shown in FIG. 1 where perforating gun 10 is seen positioned within well pipe 12. A generally cylindrical support structure 14 has a vertically oriented (in FIG. 1) longitudinal axis, and comprises a number of segments 14*a*, 14*b*, etc., that are secured together in sequential manner. Each segment has a generally cylindrical configuration and perforations 16a, 16b, etc., to expose the interior of support structure 14 and the explosive penetrators 18a, 18b, etc., secured therein to the interior of well pipe 12. Each explosive penetrator 18a, 18b, etc., comprises a shaped charge which emits a directed output upon detonation and is situated so that the shaped charge is directed towards well pipe 12 through the respective perforations 16a, 16b, etc., in support structure 14. Perforating guns typically comprise 10 to 20 explosive penetrators.

Perforating gun 10 also comprises a fireset assembly 20 secured to support structure 14. Fireset assembly 20 comprises an electronic fireset circuit and a small detonating charge that can be fired by the circuit at the appropriate time. A mild detonating ribbon fuse (not shown in FIG. 1) conveys the initiating blast from the fireset to explosive penetrators 18a, 18b, etc., so that when the fireset emits a firing signal, explosive penetrators 18a, 18b, etc., will detonate, perforating well pipe 12. The shaped charges within explosive penetrators 18a, 18b, etc., are of sufficient strength to not only perforate well pipe 12 but also to penetrate a surrounding concrete sheath and surrounding earth formations to allow oil or gas to flow into well pipe 12.

Figure 2:
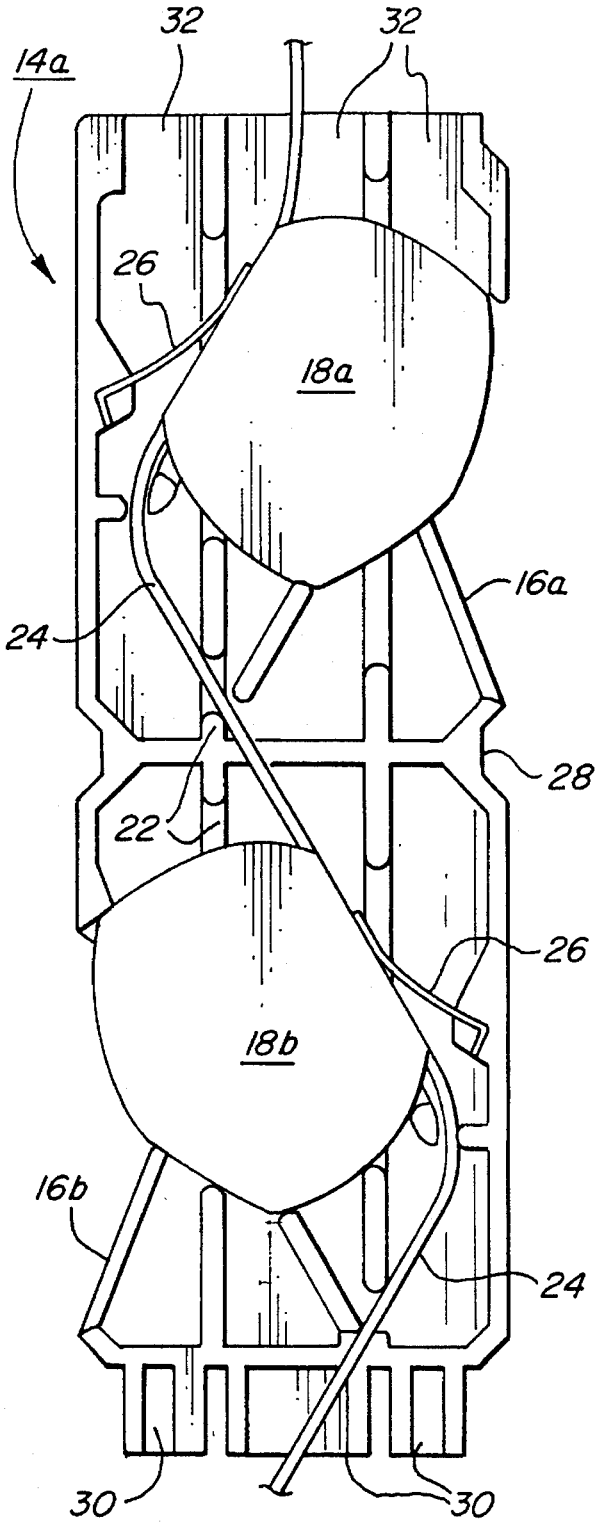
FIG. 2 is a schematic plan view of one segment of the perforating gun of FIG. 1, enlarged with respect to FIG. 1, with one half of the support structure removed.

Each segment 14a, 14b, etc., of support structure 14 is divided along its longitudinal axis into two halves. FIG. 1 shows a support structure in which pairs of explosive penetrators are disposed in alternating directions, two right (as sensed in FIG. 1), and two left; in an alternative embodiment, the explosive penetrators may alternate singly. A segment of the support structure showing this alternative configuration is shown in FIG. 2 where segment 14a' is shown with one half removed to expose the interior of the segment. As is evident from FIG. 2, there is in the interior of each segment a plurality of stiffening and positioning cleats 22 which are dimensioned and configured to lend structural strength to the support structure, to define positioning seats for receiving the explosive penetrator 18a, 18b, etc., and to define a path through which a detonating ribbon fuse 24 may extend through the segment. Leaf springs 26 mounted in segment 14a' maintain ribbon fuse 24 in detonation transfer relation to the explosive penetrators. As is evident from FIG. 2, the explosive penetrators 18a, 18b, etc., are oriented so that their outputs are directed through perforations 16a, 16b, etc., at an angle of about 60° with respect to the longitudinal axis of the support structure.

When the explosive penetrators and ribbon fuse are properly situated in the seats and path defined by cleats 22, the second half of the segment is fitted in place. A metal band is cinched into a groove 28 around the outside of the segment to keep the two halves together. At one end, segment 14a' defines three tenons 30 and at the other end, segment 14a' defines three mortice apertures 32 dimensioned and configured to receive similarly configured tenons, which can be secured therein by a suitable adhesive.

Figure 3:
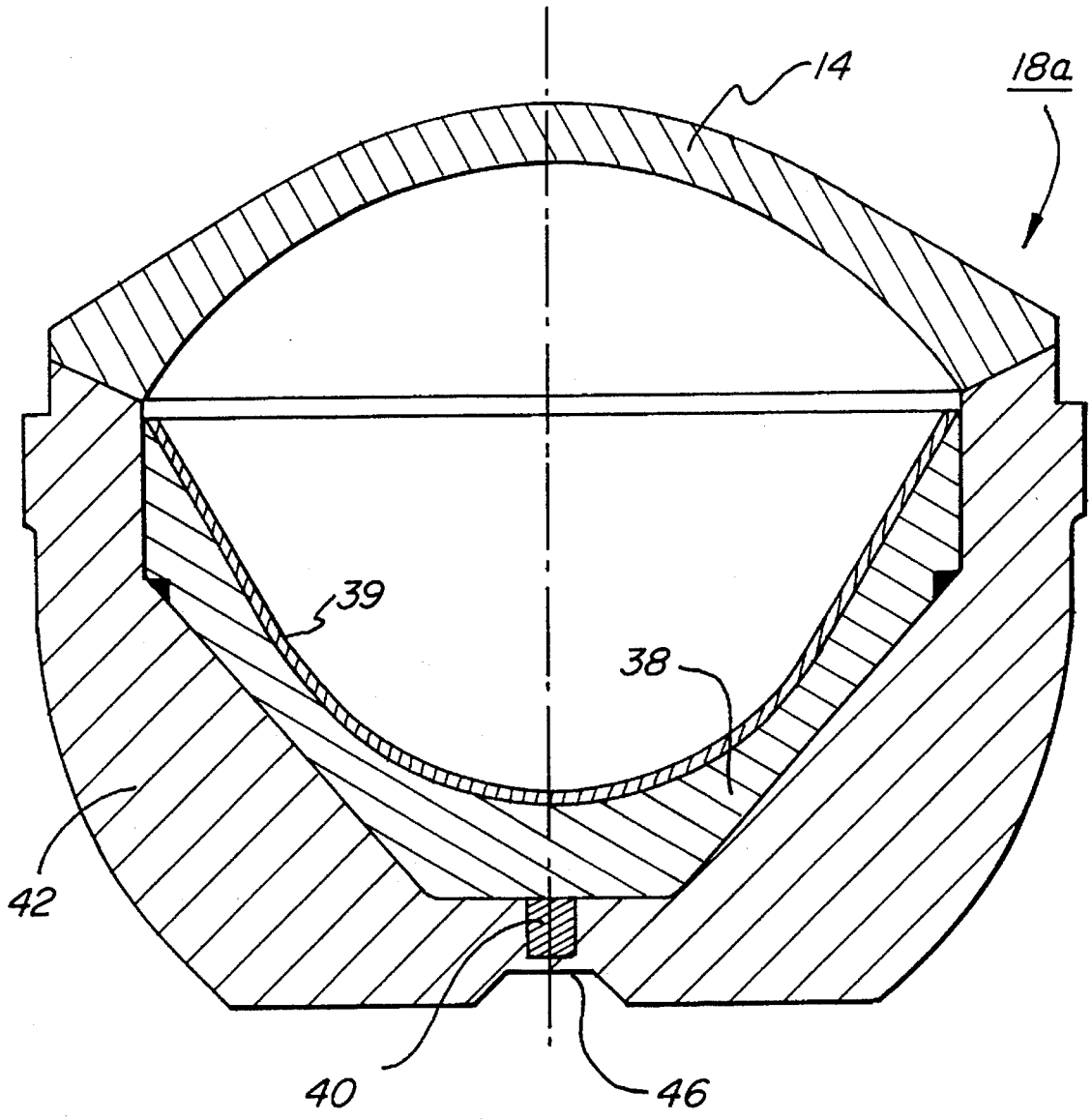
FIG. 3 is a schematic cross-sectional view of an explosive penetrator of the perforating gun of FIG. 1.

Explosive penetrator 18a is shown in schematic cross section in FIG. 3. Explosive penetrator 18a comprises a main charge 38 shaped by a liner 39 and an explosive initiation pellet 40 disposed within a casing that comprises a housing 42 and a cover 44. Housing 42 defines a fuse slot 46 within which ribbon fuse 24 (FIG. 2) is disposed and retained by a leaf spring 26. When ribbon fuse 24 detonates, the impact penetrates housing 42 to initiate pellet 40, which in turn detonates shaped charge 38. Ribbon fuse 24 is detonated by fireset assembly 20 as described below. Fireset assembly 20 (FIG. 1) comprises firing circuitry and an initiating explosive charge disposed within a pulverable housing. The housing comprises tenons that facilitate the mounting of fireset assembly 20 onto support structure 14 by insertion of the tenons into the mortice apertures of the initial segment of the support structure. The ribbon fuse 24 is disposed against the fireset casing in detonation transfer relation to the initiating explosive within the fireset casing, in a manner similar to the position of ribbon fuse 24 and initiation pellet 40, as shown in FIG. 3. Thus, when the fireset circuitry fires the initiating charge, the initiation signal is transferred to ribbon fuse 24 and then to the explosive penetrators in the gun.

To facilitate the proper positioning of perforating gun 10 in well pipe 12, support structure 14 carries at least one sealing ring 34 (FIG. 1) thereon. While support structure 14 and fireset assembly 20 are dimensioned and configured to fit easily within well pipe 12 without engaging the interior surface thereof, sealing rings 34 encircle perforating gun 10 and are dimensioned and configured to slideably engage the interior of well pipe 12. Sealing rings 34 may comprise synthetic polymeric material such as Teflon™ polytetrafluoroethylene, overbraided with stainless steel and they help to center perforating gun 10 within well pipe 12 and to provide at least a partial seal therebetween. The seal allows the operator to position perforating gun 10 within well pipe 12 by pumping a fluid medium into well pipe 12 after perforating gun 10 is inserted therein. By controlling the pressure of the fluid in well pipe 12 above perforating gun 10, the position of perforating gun 10 can be controlled. In a typical embodiment, the well pipe may have an internal diameter of 4.55 to 4.67 inches whereas support structure 14 in fireset assembly 20 may have diameters of 4.25 inches, leaving a gap that is bridged by the sealing rings.

To insert the gun into the well, the gun is mounted in a device known as a lubricator 36, shown schematically in FIG. 1, which is mounted on the earth surface at the top of the well. The lubricator comprises a pumping mechanism that creates a head of pressure above the perforating gun to propel the perforating gun into the well against the pressure of ground water that may be present therein. Since the pressure of the ground water is a function of the depth of the well, the gun can be positioned to a desired depth by controlling the head space pressure created by lubricator 36.

In use, perforating gun 10 is positioned in lubricator 36 and, if necessary, the fireset circuitry is armed. Lubricator 36 propels perforating gun 10 into well pipe 12 to a desired depth determined by the pressure imposed by lubricator 36 above the sealing rings 34. Fireset assembly 20 is designed to detonate the ribbon fuse 24 when perforating gun 10 has reached the desired depth, and may therefore comprise a depth-sensing means such as a pressure switch. Accordingly, there is no need for a wave line to connect the fireset to an initiating device of the well surface, i.e., the fireset is autonomous. Ribbon fuse 24 in turn detonates the explosive penetrators 18a, 18b, etc., perforating well pipe 10 and the surrounding concrete and earth formation. When explosive penetrators 18a, 18b, etc., are detonated, support structure 14 disintegrates into fragments too small to obstruct the flow of oil or gas from the surrounding earth formation into or through well pipe 12.

By providing a perforating gun which comprises a pulverable support structure, the present invention obviates the need for lengthy suspension chains for holding explosive penetrators in the well pipe, and avoids clogging of the well pipe by fragments of a metal cylindrical casing. A pulverable support structure for use in the present invention can be manufactured easily and inexpensively, and the resulting support structure, which can be manufactured in longitudinal halves as described above, allows for simple assembly of a perforating gun comprising any number of desired segments.

While the invention has been described in detail with reference to a particular embodiment thereof, it will be apparent that upon a reading and understanding of the foregoing, numerous variations to the described embodiment will occur to those skilled in the art and it is intended to include such variations within the scope of the appended claims.

What is claimed is:

1. In a well pipe perforating gun comprising a support structure, at least one explosive penetrator and a fireset operatively connected to the at least one explosive penetrator, the support structure being dimensioned and configured to juxtapose the at least one explosive penetrator in perforating relation to the interior of the well pipe, the improvement comprising that the support structure comprises a pulverable material, whereby the support structure disintegrates into non-obstructive debris when the gun is fired.

2. The perforating gun of claim 1 wherein the pulverable material comprises a phenolic material.

3. The perforating gun of claim 1 wherein the support structure comprises a sealing means dimensioned and configured to slideably engage the interior of the pipe.

4. The perforating gun of claim 1, claim 2 or claim 3 wherein the support structure is perforated, and wherein the fireset and the explosive penetrator comprise pulverable protective casings.

5. The perforating gun of claim 1, claim 2 or claim 3 wherein the support structure comprises a plurality of sequentially linked segments.

6. The perforating gun of claim 5 wherein each segment has a generally cylindrical configuration having two ends and comprises at least one tenon at one end and a mortise aperture an the other end, the mortise aperture being dimensioned and configured to receive a tenon dimensioned and configured like the at least one tenon.

7. The perforating gun of claim 1 wherein the fireset comprises an autonomous fireset.

* * * * *

UNITED STATES PATENT AND TRADEMARK OFFICE

CERTIFICATE OF CORRECTION

PATENT NO. : 5,477,785

DATED : December 26, 1995

INVENTOR(S) : Charles A. Dieman, Jr. et al

It is certified that error appears in the above-indentified patent and that said Letters Patent is hereby corrected as shown below:

--

In column 2, line 59, remove the period after "Chemical".

In claim 6, column 6, line 14, replace "an" with --at--.

Signed and Sealed this

Thirtieth Day of July, 1996

*Attest:*

Bruce Lehman

BRUCE LEHMAN

*Attesting Officer*

*Commissioner of Patents and Trademarks*